US010920476B1

(12) United States Patent
Jeong et al.

(10) Patent No.: US 10,920,476 B1
(45) Date of Patent: Feb. 16, 2021

(54) HINGE DEVICE FOR ROTATING DOOR

(71) Applicant: PARTSTEC CONSTRUCTION CO., LTD, Gumi-si (KR)

(72) Inventors: Kil Seok Jeong, Gumi-si (KR); In Ho Cho, Gyeongsangbuk-do (KR); Jae Yeong Jeong, Gumi-si (KR)

(73) Assignee: PARTSTEC CONSTRUCTION CO., LTD, Gumi-si (KR)

( * ) Notice: Subject to any disclaimer, the term of this patent is extended or adjusted under 35 U.S.C. 154(b) by 0 days.

(21) Appl. No.: 16/676,475

(22) Filed: Nov. 7, 2019

(30) Foreign Application Priority Data

Sep. 30, 2019 (KR) ..... 10-2019-0121088

(51) Int. Cl.

| | |
|---|---|
| ***E05F 3/20*** | (2006.01) |
| ***E05F 1/12*** | (2006.01) |
| ***E05F 3/22*** | (2006.01) |
| ***E05F 3/08*** | (2006.01) |

(52) U.S. Cl.
CPC ..... *E05F 3/20* (2013.01); *E05F 1/1223* (2013.01); *E05F 3/08* (2013.01); *E05F 3/22* (2013.01); *E05Y 2900/31* (2013.01)

(58) Field of Classification Search
CPC ..... E05F 3/20; E05F 3/22; E05F 3/08; E05F 1/12; E05F 1/1215; E05F 1/1223; E05D 2011/1035; E05D 11/105
See application file for complete search history.

(56) References Cited

U.S. PATENT DOCUMENTS

| | | | | |
|---|---|---|---|---|
| 4,325,164 | A * | 4/1982 | Sasaki | E05F 3/08 16/52 |
| 5,697,122 | A * | 12/1997 | Okabe | E05F 3/14 16/82 |
| 5,769,188 | A * | 6/1998 | Okabe | A47K 13/12 188/82.84 |
| 7,966,693 | B2 * | 6/2011 | Choi | E05F 3/20 16/54 |
| 8,307,503 | B1 * | 11/2012 | Burger | E05F 1/1215 16/277 |
| 8,516,657 | B2 * | 8/2013 | Yoshida | E05F 3/20 16/50 |
| 9,739,523 | B1 * | 8/2017 | Augsburger | F25D 23/028 |
| 2009/0025181 | A1 * | 1/2009 | Burger | E05F 3/14 16/286 |
| 2016/0083993 | A1 * | 3/2016 | Grewe | E05F 1/1223 16/291 |

FOREIGN PATENT DOCUMENTS

| | | | |
|---|---|---|---|
| KR | 10-2006-0099355 | A | 9/2006 |
| KR | 10-2006-0119459 | A | 11/2006 |

* cited by examiner

*Primary Examiner* — Jeffrey O'Brien

(57) ABSTRACT

The present invention relates to a hinge device for a rotating door, and more particularly, to a hinge device for a rotating door, which is mounted on the rotating door so that the door can be opened and closed while rotating in various ways. The hinge device for the rotating door of the present invention rotates by an external force and then rotated in a free stop manner at a certain section, and automatically rotates in a reverse direction at a section where the hinge device reversely rotates after free stop rotation.

15 Claims, 12 Drawing Sheets

C-C

HINGE DEVICE FOR ROTATING DOOR

CROSS REFERENCE TO RELATED APPLICATIONS

The present application claims the benefit of Korean Patent Application No. 10-2019-0121088 filed on Sep. 30, 2019, the contents of which are incorporated herein by reference in their entirety.

BACKGROUND OF THE INVENTION

1. Field of the invention

The present invention relates to a hinge device for a rotating door, and more particularly, to a hinge device for a rotating door, which is mounted on the rotating door to allow the rotating door to be opened and closed while rotating in various ways.

2. Description of the Prior Art

A configuration in which a door is hinged to a specific body object to open or close an inside of the specific body object is generally known in the art.

For example, a refrigerator includes a body for storing foods and a door for opening or closing the body.

When the door of the refrigerator is opened by a great amount of external force, the door may collide with other objects so that the door may be damaged.

In addition, when the door of the refrigerator is closed by a great amount of external force, the body of the refrigerator may be subject to great impact so that a problem may occur because bowls and the like stored inside the refrigerator may be subject to the great impact.

In order to solve the above problem, conventionally, damping force is generated when the door of the refrigerator is opened or closed such that the door can be opened or closed slowly.

However, according to the conventional door of the refrigerator, the same damping force is applied when the door of the refrigerator is opened and closed, thereby causing a problem in which the door of the refrigerator door is opened too slowly when the damping force is large and shock is applied to body of the refrigerator when the damping force is small because the door of the refrigerator is closed at the speed the same as the speed generated when the door of the refrigerator is opened.

In addition, when a large or heavy object or a plurality of objects are put into or removed from the refrigerator, it is necessary to open the door of the refrigerator for a long period of time.

According to the conventional refrigerator, when a plurality of objects are put into or removed from the refrigerator, it is necessary for a user to put or remove the objects into or from the refrigerator by holding the door of the refrigerator such that the door is not closed because the door is automatically closed.

[Prior Technical Documents]

[Patent Documents]

Unexamined Patent Publication No. 10-2006-0119459

Unexamined Patent Publication No. 10-2006-0099355

SUMMARY OF THE INVENTION

The present invention has been made in an effort to solve the above-mentioned problems, and provides a hinge device for a rotating door, in which a door of a refrigerator can be conveniently opened and closed by allowing the door to rotate at different speeds when the door is opened or closed with respect to a body object (a refrigerator, etc.), and the door, which is opened by rotating with respect to the body object, can be maintained in an opened state so that a user can conveniently put or remove things without interfering with the door when the things are put into or removed from an inside of the body object.

In order to accomplish the above object, a hinge device for a rotating door according to the present invention includes: a hollow housing provided therein with a first inner chamber and a second inner chamber communicated with each other, in which the first inner chamber is filled with oil; a shaft rotatably mounted to the housing while passing through the first inner chamber, in which one end of the shaft is exposed to an outside through one end of the housing, an opposite end of the shaft is inserted into the first inner chamber, an outer circumferential surface of the shaft is spaced apart from the first inner chamber such that oil is filled therebetween, and a first seating groove is formed at an outer circumferential surface of the opposite end of the shaft; a damper unit installed in the first inner chamber to adjust an amount of flow of the oil filled in the first inner chamber during relative rotation of the housing and the shaft; a clutch roll inserted into the first seating groove in the second inner chamber; a clutch member having one end surrounding the opposite end of the shaft in the second inner chamber, in which a first coupling protrusion protrudes from an opposite end of the clutch member, a through hole is formed at the one end of the clutch member surrounding the shaft, and the clutch roll is inserted into the through hole; a support member mounted to the opposite end of the housing and having a second coupling protrusion protruding toward an inside of the housing; and a torsion spring installed inside the housing and having one end coupled to the first coupling protrusion and an opposite end coupled to the second coupling protrusion, wherein a second seating groove is formed at an inner peripheral surface of the housing such that the clutch roll inserted into the through hole is seated in the second seating groove, a rotational force of the shaft is transferred to the clutch member through the clutch roll when the shaft rotates in a state where the clutch roll is inserted into both the first seating groove and the through hole, thereby rotating the clutch member together with the shaft, and only the shaft independently rotates without rotation of the clutch roll and the clutch member when the shaft rotates in a state where the clutch roll is inserted into both the through hole and the second seating groove.

The hinge device of the rotating door may include: a compression section, in which the clutch member rotates together with the shaft from an initial stop position to a predetermined first angle to compress the torsion spring when the shaft rotates forward by an external force; a free stop section in which the shaft rotates freely without compression or decompression of the torsion spring when the shaft rotates forward or backward in a state of exceeding the predetermined first angle; and a recovery section in which the shaft automatically rotates in a reverse direction by an elastic restoring force of the torsion spring to return to the initial stop position when the shaft rotates reversely below the predetermined first angle in the free stop section.

The second seating groove may be formed at a position corresponding to the predetermined first angle, the clutch roll may be inserted into the first seating groove and the through hole in the compression section and the recovery section so that the shaft, the clutch roll, and the clutch member rotate together, and the clutch roll may be inserted into the through hole and the second seating groove in the free stop section so that the shaft rotates independently from the clutch roll and the clutch member.

Each of a depth of the first seating groove, a depth of the second seating groove, and a depth of the through hole may be smaller than a diameter of the clutch roll, so that a center point of the clutch roll may be disposed outside the first seating groove in a state where the clutch roll is inserted into the first seating groove and the through hole, and the center point of the clutch roll may be disposed outside the second seating groove in a state where the clutch roll is inserted into the second seating groove and the through hole.

In a state where the clutch roll is inserted into the first seating groove and the through hole, when the shaft rotates forward beyond the predetermined first angle, the first seating groove, the through hole, and the second seating groove may communicate with each other, and the clutch roll may come out of the first seating groove and may be inserted into the through hole and the second seating groove by the rotation of the shaft, and in a state where the clutch roll is inserted into the second seating groove and the through hole, when the shaft reversely rotates beyond the predetermined first angle, the first seating groove, the through hole, and the second seating groove may communicate with each other, and the clutch roll may come out of the first seating groove and may be inserted into the through hole and the second seating groove by the rotation of the clutch member caused by the elastic restoring force of the torsion spring.

A reverse rotational force caused by the elastic restoring force of the torsion spring may be applied to the shaft in the initial stop position.

The first seating grooves may be formed at intervals of 120 degrees, the clutch roll includes three clutch rolls, the second seating grooves may be formed at intervals of 120 degrees, and the predetermined first angle may be less than 90 degrees at the initial stop position.

The housing may include: a first housing in which the shaft is disposed; and a second housing having one end coupled to the opposite end of the first housing and an opposite end on which the support member is mounted, and provided therein with the torsion spring, and a latching protrusion may protrude between one end and the opposite end of the clutch member in a circumferential direction, and the latching protrusion may be mounted between the first and second housings such that the latching protrusion is rotatable and linear movement of the latching protrusion is prevented.

The hinge device may further include a bearing surrounding the opposite end of the clutch member, wherein one end of the bearing may be latched to an inner peripheral surface of one end of the second housing, and the latching protrusion may be disposed between the bearing and the opposite end of the first housing so that the latching protrusion is rotatable and the linear movement of the bearing is prevented.

The hinge device may further include: a height adjusting nut screwed to one end of the housing; a height adjusting ring having one end exposed to an outside of one end of the height adjusting nut and one end of the housing, and an opposite end inserted between the height adjusting nut and the housing; and a snap ring configured to couple the height adjusting nut and the height adjusting ring to move the height adjusting nut and the height adjusting ring together in a longitudinal direction of the housing, wherein, when the height adjusting nut rotates relative to the housing, the height adjusting ring coupled to the height adjusting nut through the snap ring may move in the longitudinal direction of the housing to adjust a distance with respect to one end of the housing.

The damper unit may include: a blocking member having one end fixedly coupled to an inner peripheral surface of the first inner chamber and an opposite end making contact with an outer circumferential surface of the shaft; and a blade disposed between the shaft and the inner peripheral surface of the first inner chamber, wherein, when the shaft rotates, the blocking member may be fixed together with the housing and the blade may move together with the shaft while making contact with the inner peripheral surface of the first inner chamber, and the blade may change an amount of movement of the oil filled in the first inner chamber.

A first fluid path may be concavely formed at the inner peripheral surface of the first inner chamber in a circumferential direction of the housing, the blade may be disposed in a longitudinal direction of the shaft, when the shaft rotates, the blade may move through a portion where the first fluid path is absent and a portion where the first fluid path is present in contact with the inner peripheral surface of the first inner chamber, the oil may move through the first fluid path when the blade is disposed in the portion where the first fluid path is present, and the shaft may rotate more slowly when the blade is disposed in the portion where the first fluid path is absent than the blade is disposed in the portion where the first fluid path is present.

A third seating groove where the blade is seated may be formed on the outer circumferential surface of the shaft, the blade may be spaced apart from the third seating groove and the oil may move therebetween when the shaft rotates forward, and the blade may come in close contact with the third seating groove to block movement of the oil between the blade and the third seating groove when the shaft reversely rotates.

The third seating groove may include: a third-first seating groove having an arc shape; and a third-second seating groove formed by chamfering the shaft from the third-first seating groove in the circumferential direction of the shaft such that the third-second seating groove has a depth greater than a depth of the third-first seating groove, and the blade may be provided with a seating protrusion seated in the third-first seating groove, the seating protrusion may be smaller than the third-first seating groove and movably disposed in the third-first seating groove, when the shaft rotates forward, the seating protrusion may be pushed toward the third-second seating groove by the oil and may allow the third-first seating groove to communicate with the third-second seating groove so that the blade may be spaced apart from the third seating groove and the oil may move therebetween, and when the shaft reversely rotates, the seating protrusion may be pushed opposite to the third-second seating groove by the oil and may come in close contact with the third-first seating groove to prevent the oil from moving between the blade and the third seating groove.

The shaft may be formed at a center thereof with a bolt insertion hole, an oil adjusting bolt may be installed in a bolt insertion hole, a bypass passage may be formed in the shaft to allow the bolt insertion hole to communicate with the outer circumferential surface of the shaft, and a size of communication between the bypass passage and the bolt insertion hole may be variable by the oil adjusting bolt so that an amount of movement of the oil through the bypass passage may be controlled.

The hinge device for the rotating door according to the present invention described above has the following advantages.

The door of the refrigerator door can be conveniently opened and closed by allowing the door to rotate at different speeds when the door rotates to be opened or closed with respect to the body object (refrigerator, etc.).

In addition, the door, which is opened by rotating with respect to the body object (refrigerator, etc.), can be maintained in an opened state so that a user can conveniently put or remove things without interfering with the door when the things are put into or removed from an inside of the body object.

In particular, according to the present invention, a free stop scheme is adopted in a section exceeding a first angle such that rotation does not occur when there is no external force, and the door is automatically rotated in a section below the first angle, so that the door can be automatically rotated and conveniently closed.

BRIEF DESCRIPTION OF THE DRAWINGS

The above and other objects, features, and advantages of the present invention will be more apparent from the following detailed description taken in conjunction with the accompanying drawings, in which.

DETAILED DESCRIPTION OF THE EXEMPLARY EMBODIMENTS

Figure 1:
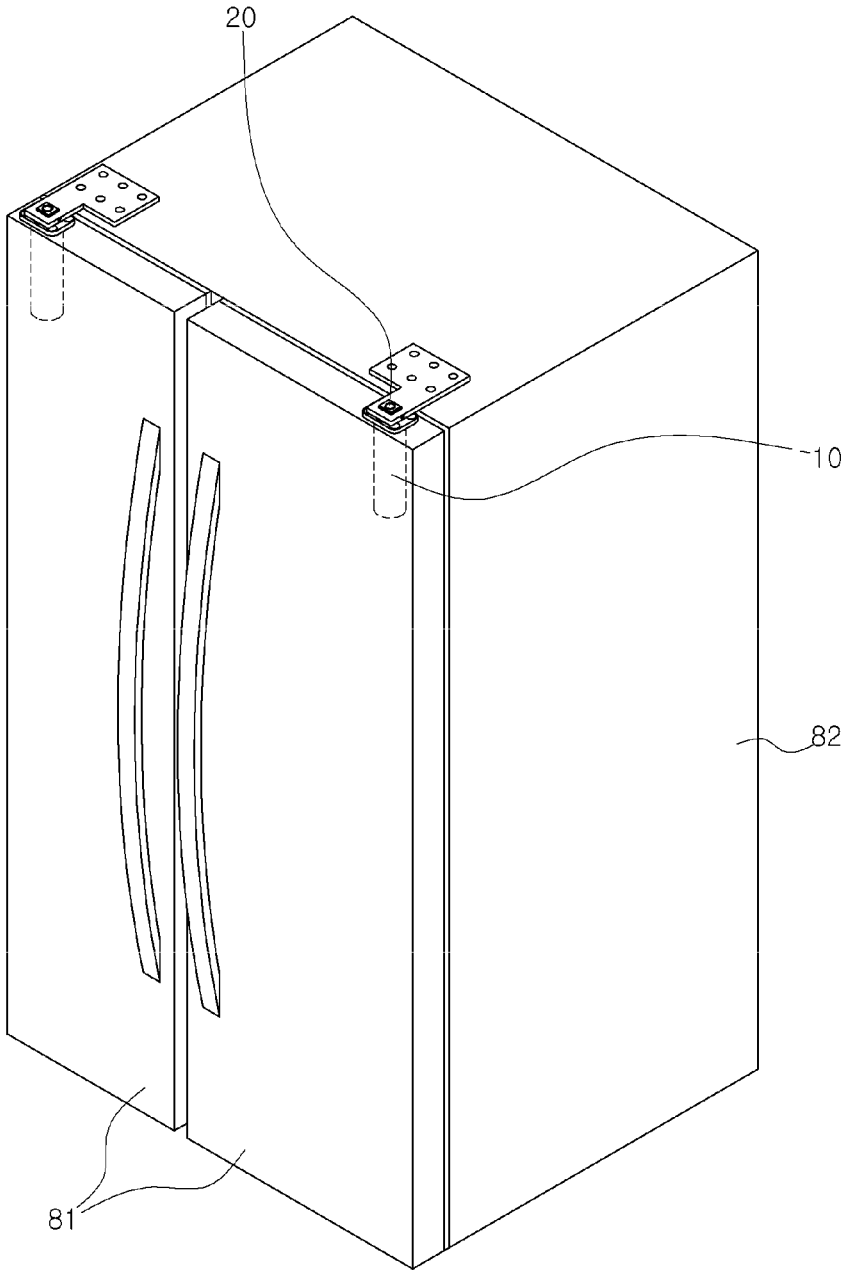
FIG. 1 is a perspective view showing a configuration in which a hinge device for a rotating door according to an embodiment of the present invention is installed on a refrigerator.
Figure 2:
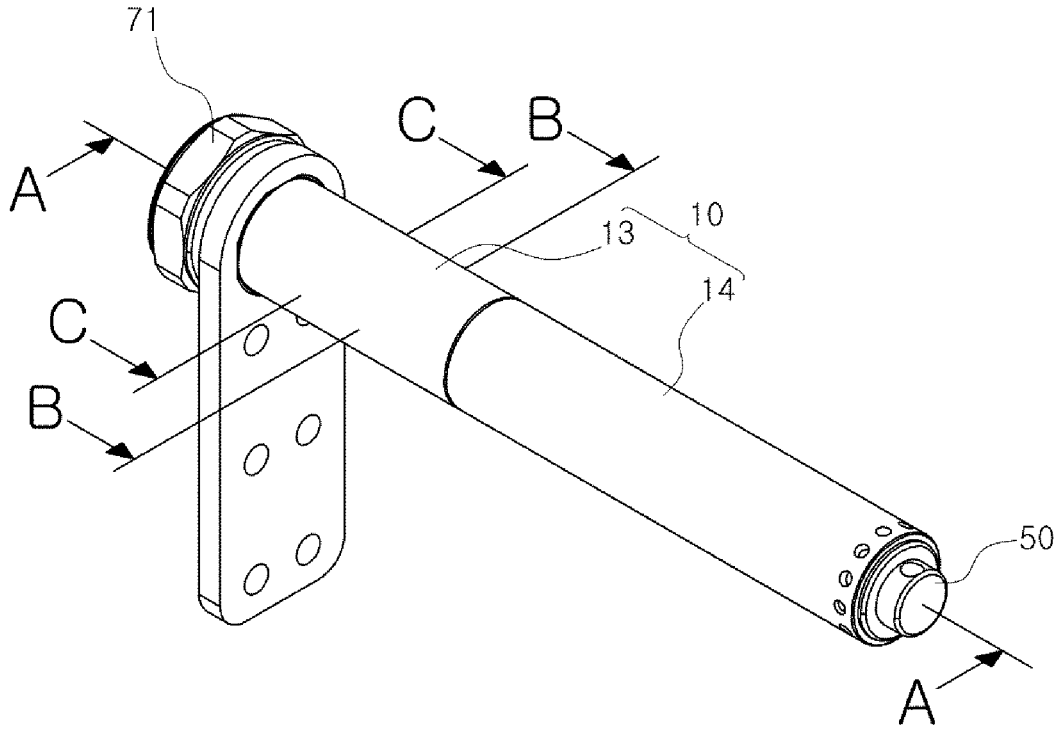
FIG. 2 is a perspective view showing a hinge device for a rotating door according to an embodiment of the present invention.
Figure 3:
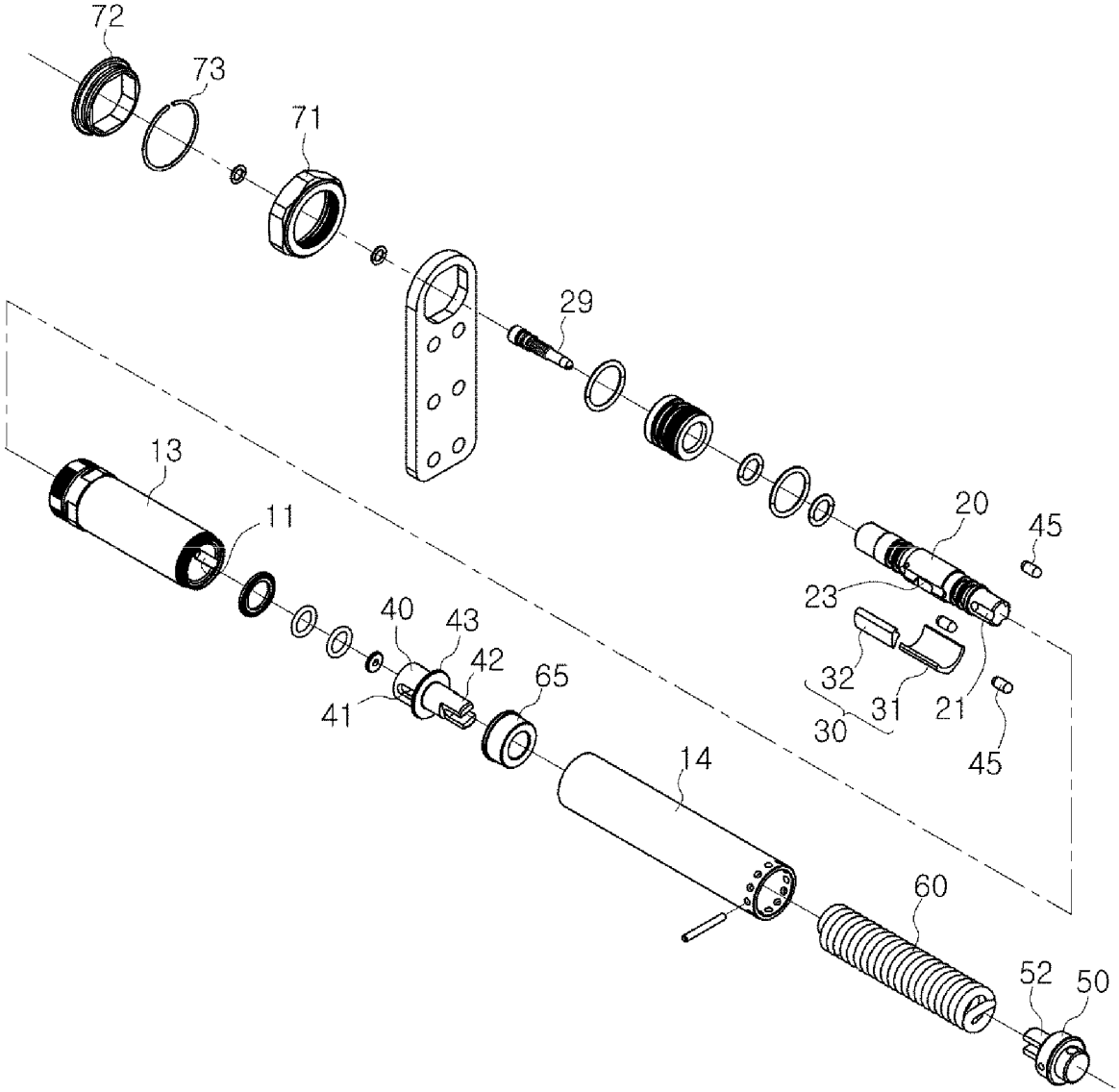
FIG. 3 is an exploded perspective view of a hinge device for a rotating door in one direction according to an embodiment of the present invention.
Figure 4:
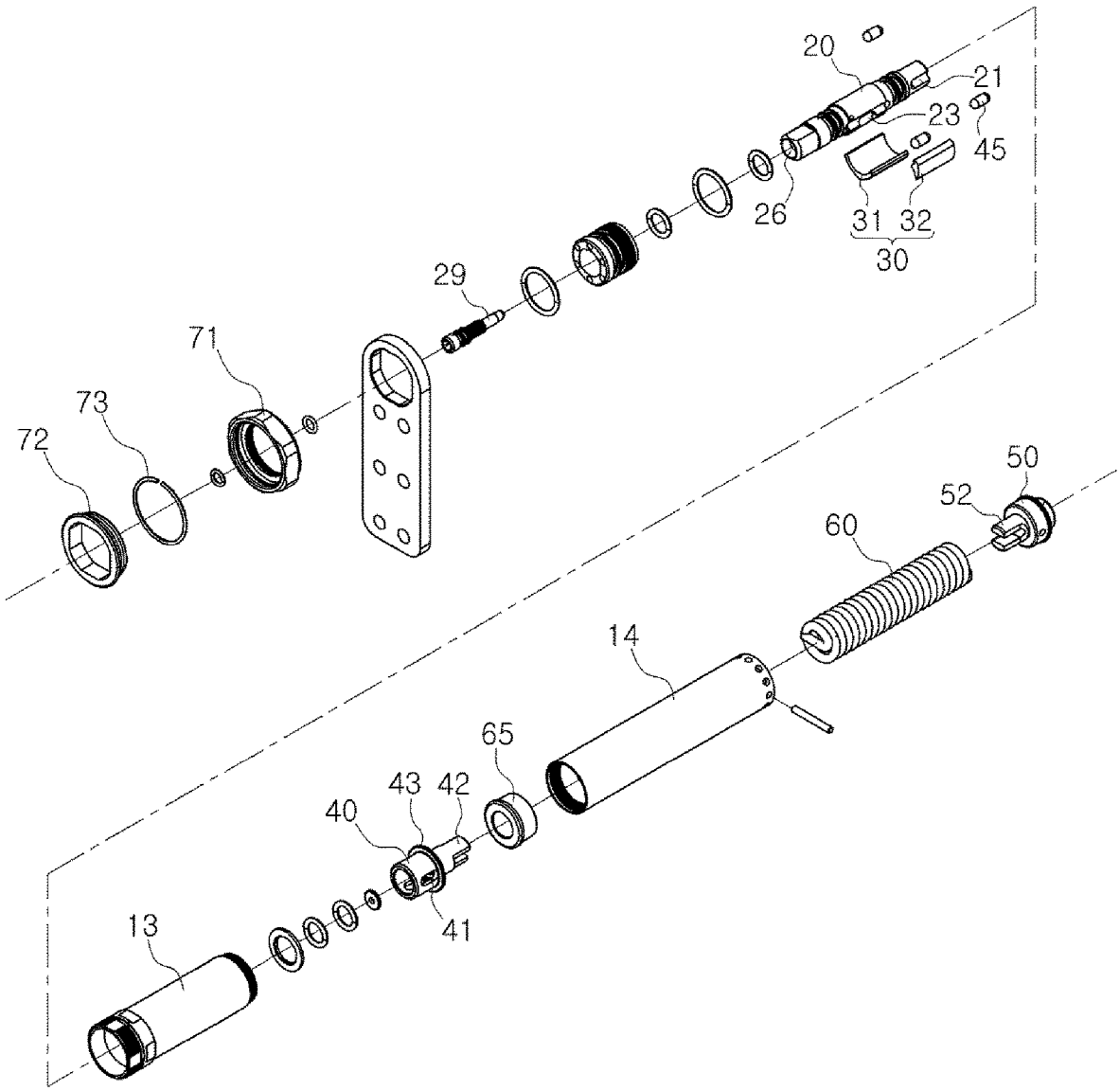
FIG. 4 is an exploded perspective view of a hinge device for a rotating door in the other direction according to an embodiment of the present invention.

As shown in FIGS. 2 to 7, the hinge device for a rotating door of the present invention may include a housing 10, a shaft 20, a damper unit 30, a clutch roll 45, a clutch member 40, a support member, and a torsion spring 60.

In the present invention, one of the housing 10 and the shaft 20 may rotate relative to the other according to the mounting position thereof.

As shown in FIG. 1, the housing 10 may be fixedly mounted on an upper portion or a lower portion of a rotating door 81, and the shaft 20 is connected to a body object 82 (refrigerator, etc.) to which the door 81 is hinged so that the housing 10 rotates with respect to the shaft 20 when the door 81 rotates.

In the present embodiment, for the sake of convenience of explanation, the shaft 20 will be described on the premise that shaft 20 rotates relative to the housing 10.

Alternatively, the shaft 20 may be fixed and the housing 10 may be installed to rotate relative to the shaft 20, but the operation process and the technical configuration and features of the present invention are the same.

The housing 10 may have a hollow pillar shape, and may be formed therein with a first inner chamber 16 and a second inner chamber 17, in which the first inner chamber 16 is filled with oil.

A second seating groove 11, in which the clutch roll 45 is seated, is formed at an inner peripheral surface of the housing 10.

As will be described below, the second seating groove 11 is formed at the inner peripheral surface of the housing 10 in a position corresponding to a predetermined first angle.

In the present embodiment, the housing 10 may be formed by coupling a first housing 13 and a second housing 14 to each other.

The housing 13 is provided therein with the shaft 20.

One end of the second housing 14 may be coupled to the other end of the first housing 13, the support member 50 may be mounted to the other end of the second housing 14, and a torsion spring 60 may be disposed in the second housing 14.

In the present embodiment, parts of the first inner chamber 16 and the second inner chamber 17 may be formed in the first housing 13 and a part of the second inner chamber 17 may be formed in the second housing 14.

The second seating groove 11 may be formed on the inner peripheral surface of the other end of the firsts housing 13.

The shaft 20 may be disposed in the housing 10 by passing through the first inner chamber 16, in detail, the shaft 20 may be rotatably mounted in the housing 10, such that one end of the shaft 20 may be exposed to the outside through one end of the housing 10, and the other end may be inserted into the second inner chamber 17.

The shaft 20 may have an outer circumferential surface spaced apart from an inner peripheral surface of the first inner chamber 16 so that oil may be filled therebetween.

A first seating groove 21 may be formed on the outer circumferential surface of the other end of the shaft 20.

The damper unit 30 may be mounted in the first inner chamber 16 to adjust the amount of movement of oil filled in the first inner chamber 16 when the housing 10 and the shaft 20 rotate relative to each other.

Figure 13:
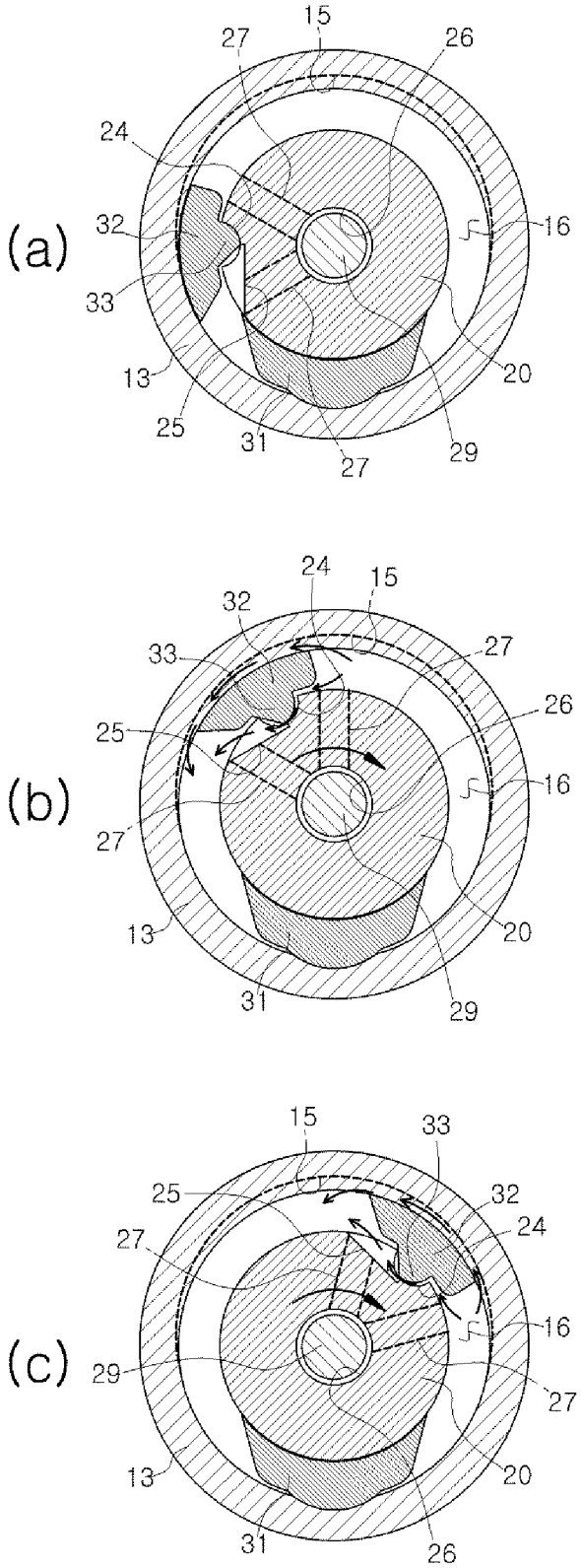
FIG. 13 is a sectional view showing a state of a damper unit in a process of forward rotation of a shaft of a hinge device for a rotating door shown in FIG. 12 according to an embodiment of the present invention.
Figure 14:
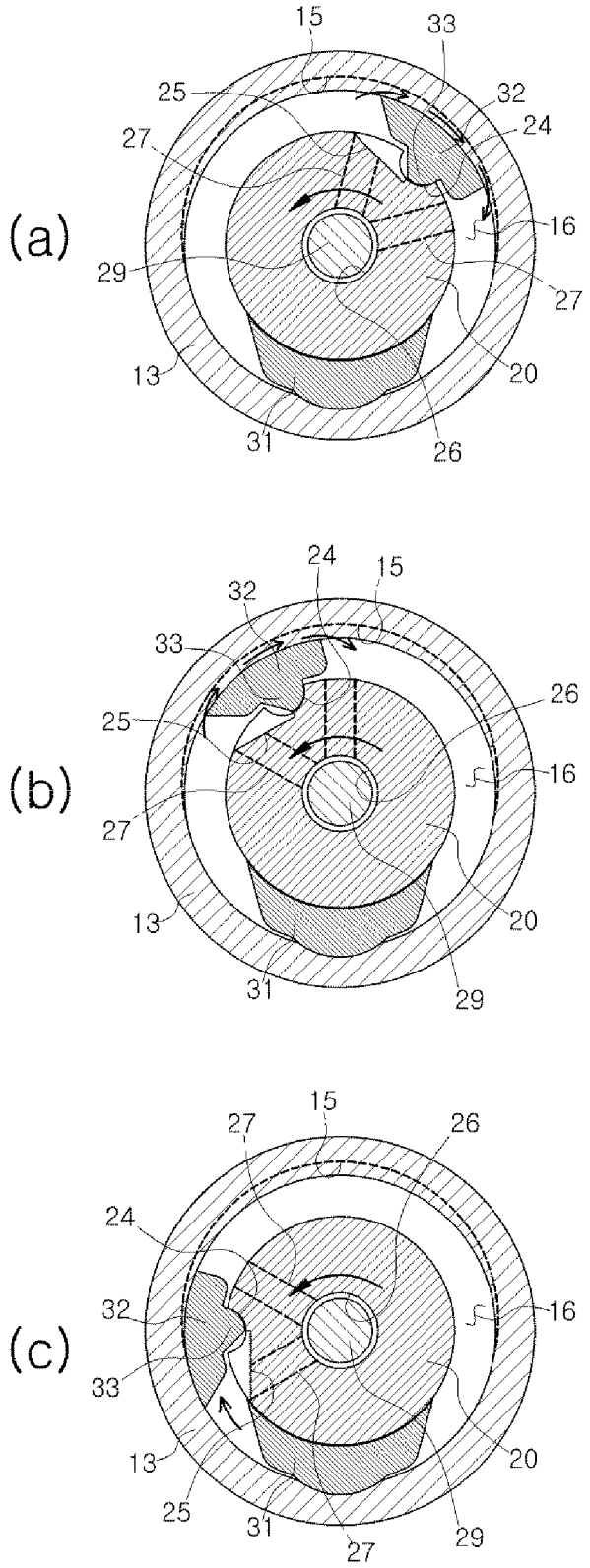
FIG. 14 is a sectional view showing a state of a damper unit in a process of forward rotation of a shaft shown in FIG. 13.

More specifically, as shown in FIGS. 13 and 14, since the amount of movement of oil is changed by the damper unit 30 while the housing 10 and the shaft 20 move relative to each other, the relative rotational speed between the housing 10 and the shaft 20 may be changed according to the rotation section and/or the direction of rotation.

The damper unit 30 may generate a damping force during the rotation of the shaft 20 or the housing 10 to reduce the rotational torque of the shaft 20 or the housing 10.

In particular, the damper unit 30 may be disposed in the first inner chamber 16 to generate different damping forces for damping the rotational torque of the shaft 20 or the housing 10 in accordance with the rotational direction when the shaft 20 or the housing 10 rotates.

That is, the damper unit 30 may generate different damping forces according to the rotational direction of the shaft 20 or the housing 10, so that the rotational torque generated when the shaft 20 or the housing 10 rotates may be dampened with different intensity according to the rotational direction.

A conventional damper unit generates the same damping force regardless of the rotational direction of the rotating body.

However, according to the present invention, the damper unit 30 may generate different damping forces according to the rotational direction of the shaft 20 or the housing 10, and thus the rotational speed of the shaft 20 or the housing may vary depending on the rotational direction when the shaft 20 or the housing 10 rotates.

According to the present embodiment, since the shaft 20 rotates, the rotational speed of the shaft 20 may vary by the damper unit 30 during the rotation of the shaft 20.

A detailed description for the structure of the damper unit 30 will be described below.

The clutch roll 45 may be formed in a cylindrical shape and may be inserted into the first seating groove 21 in the second inner chamber 17.

One end of the clutch member 40 may surround the other end of the shaft 20 in the second inner chamber 17 and a first coupling protrusion 42 may protrude from the other end of the clutch member 40.

Figure 6:
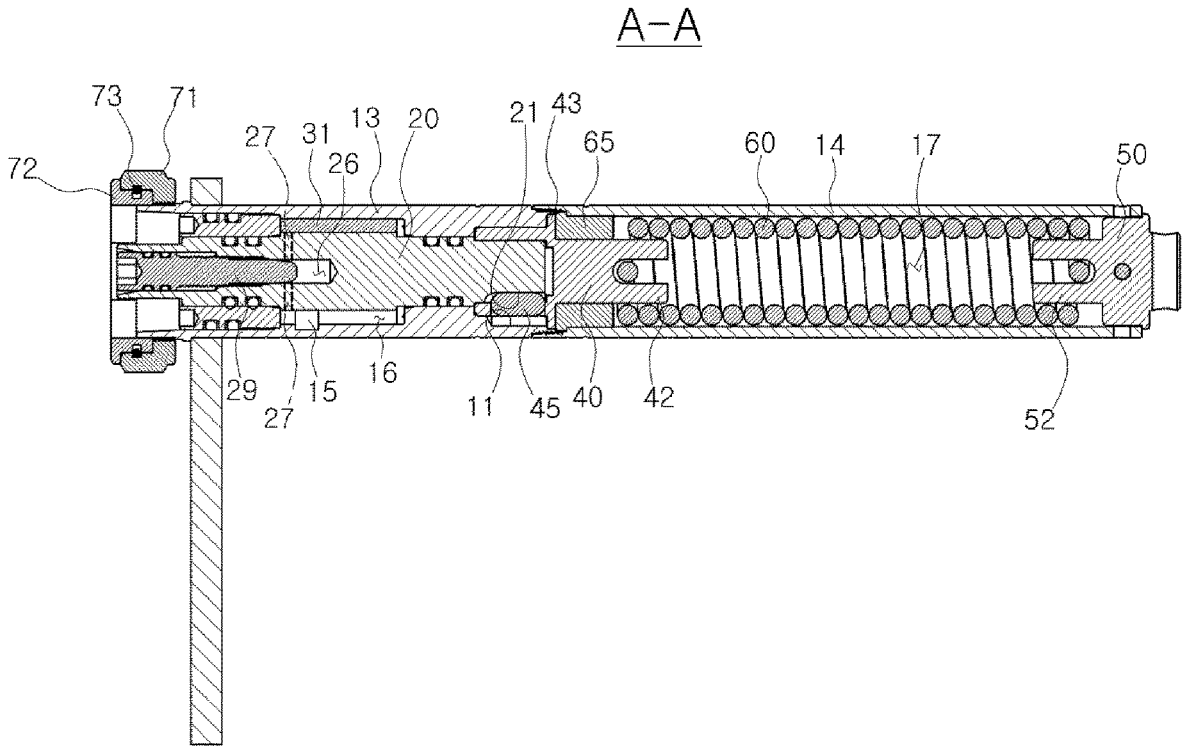
FIG. 6 is a sectional view taken along line A-A of FIG. 2.

A latching protrusion 43 may protrude in the circumferential direction between one end and the other end of the clutch member 40, and, as shown in FIG. 6, the latching protrusion 43 may rotate between the first housing 13 and the second housing, but linear movement of the latching protrusion 43 may be prevented.

The other end of the clutch member 40 is equipped with a bearing 65 surrounding the other end of the clutch member 40.

One end of the bearing 65 may be coupled the inner peripheral surface of one end of the second housing 14, and the latching protrusion 43 may be disposed between the bearing 65 and the other end of the first housing 13 so that the bearing 65 is rotatable and linear movement of the bearing 65 is prevented.

Due to the above configuration, the clutch member 40 and the bearing 65 may rotate in the housing 10, but the linear movement thereof may be prevented.

One end of the clutch member 40 surrounding the shaft 20 may be formed with a through hole 41 into which the clutch roll 45 is inserted.

Figure 7:
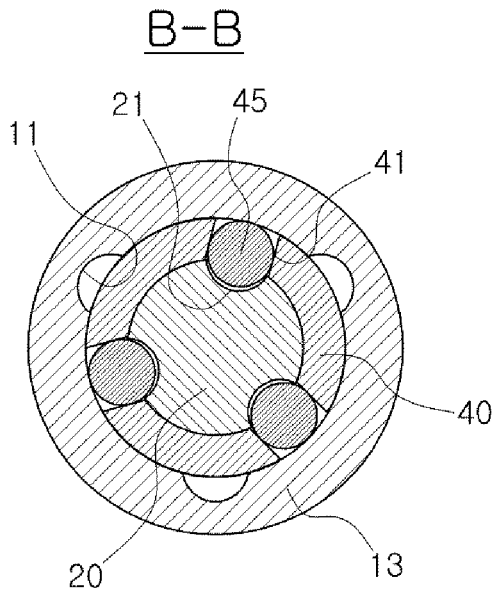
FIG. 7 is a sectional view taken along line B-B of FIG. 2.

As shown in FIG. 7, the through hole 41 may communicate with the first seating groove 21 or the second seating groove 11 according to the rotation of the shaft 20.

The clutch roll 45 inserted into the through hole 41 may be disposed in the through hole 41 and may be selectively inserted into the first seating groove 21 or the second seating groove 11 according to the rotation angle of the shaft 20.

In a state where the clutch roll 45 is inserted into both the first seating groove 21 and the through hole 41, when the shaft 20 rotates, the rotational force of the shaft 20 may be transferred to the clutch member 40 through the clutch roll so that the clutch member 40 may rotate together with the shaft 20.

In addition, in a state where the clutch roll 45 is inserted into both the through hole 41 and the second seating groove 11, only the shaft 20 may rotate independently from the clutch roll 45 and the clutch member 40 when the shaft 20 rotates.

According to the present embodiment, the first seating grooves 21 may be formed at intervals of 120 degrees, the clutch roll 45 may include three clutch rolls, and the second seating grooves 11 may be formed at intervals of 120 degrees.

Unlike the present embodiment, the number and angle of the first seating groove 21, the clutch roll 45, and the second seating groove 11 may be adjusted.

The support member 50 may be installed on the other end of the housing 10, in detail, on the other end of the second housing 14 and have a second coupling protrusion 52 protruding toward an inside of the housing 10.

The torsion spring 60 may be disposed in the housing 10, in detail, on the other end of the second housing 14, and may have one end coupled to the first coupling protrusion 42 provided on the clutch member 40, and the other end coupled to the second coupling protrusion 52 provided on the support member 50.

The torsion spring 60 may apply a force to rotate the clutch member 40 in the reverse rotational direction.

The torsion spring 60 may be placed in a compressed state to some extent even in the initial stop position where the shaft 20 is not rotated, so the reverse rotational power may be applied to the shaft by the elastic restoring force of the torsion spring 60.

Therefore, even when no external force is applied, the reverse rotational force may act on the shaft 20 so that the door 81 may come in close contact with the body object 82.

The hinge device for a rotating door of the present invention may operate in a compression section, a free stop section, and a recovery section.

The compression section may be a section for compressing the torsion spring 60, in which the clutch member 40 may rotate together with the shaft 20 from the initial stop position to the predetermined first angle when the shaft 20 rotates forward by the external force, thereby compressing the torsion spring 60.

The first angle may be formed at an angle smaller than 90 degrees from the initial stop position.

For example, in the drawings of the present embodiment, the first angle is set as 75 degrees, and the compression section is set as a forward rotation section from the initial stop position, that is, from 0 to 75 degrees, but the present invention is not limited thereto.

In the compression section, the clutch roll 45 may be inserted into both the through hole 41 and the first seating groove 21 so that the clutch roll 45 may connect the shaft 20 with the clutch member 40 when the shaft 20 rotates. Thus, the shaft 20, the clutch roll 45 and the clutch member 40 may rotate together so that the rotational force of the shaft 20 may be transferred to the clutch member 40 and the torsion spring 60 may be compressed by the rotation of the clutch member 40.

The free stop section may be a section in which the shaft 20 may rotate freely without the force of the torsion spring 60. When the shaft 20 rotates in the forward or reverse direction beyond the first angle, the shaft 20 may freely rotate without compression or decompression of the torsion spring 60.

In the drawing of the present embodiment, the free stop section is illustrated as a range from a point exceeding the first angle, that is, from a point exceeding 75 degrees to 180 degrees.

In the free stop section, the clutch roll 45 may be inserted into both the through hole 41 and the second seating groove 11 without being seated in the first seating groove 21, so that the shaft 20 may rotate independently from the clutch roll 45 and the clutch member 40 when the shaft 20 rotates.

The recovery section may be a section in which the rotated shaft 20 rotates in the reverse direction to return back to the initial stop position. When the shaft 20 reversely rotates from the free stop section to the section located below the first angle, the shaft 20 may automatically rotate in the reverse direction by the elastic restoring force of the torsion spring 60 so that the shaft 20 may return to the initial stop position.

In the drawing of the present embodiment, the recovery section is illustrate as a reverse rotation section having a range from the first angle, that is, from 75 degrees to 0 degree.

In order to allow the clutch roll 45 to be smoothly moved and inserted into the first seating groove 21 and the second seating groove 11 when the shaft 20 rotates, each of a depth of the first seating groove 21, a depth of the second seating groove 11, and a depth of the through hole 41 may be smaller than a diameter of the clutch roll 45.

In addition, in a state where the clutch roll 45 is inserted into the first seating groove 21 and the through hole 41, a center point of the clutch roll 45 may be out of the first seating groove 21. Further, in a state where the clutch roll 45 is inserted into the second seating groove 11 and the through hole 41, a center point of the clutch roll 45 may be out of the second seating groove 11.

As described above, since the center point of the clutch roll 45 is disposed outside the first seating groove 21 and the second seating groove 11, the clutch roll 45 may be easily moved and inserted into the first seating groove 21 and the second seating groove 11 when the shaft 20 rotates.

More specifically, in a state where the clutch roll 45 is inserted into the first seating groove 21 and the through hole 41, when the shaft 20 rotates forward beyond the first angle, the first seating groove 21, the through hole 41, and the second seating groove 11 may communicate with each other.

In this case, the clutch roll 45 having the center point outside the first seating groove 21 may come out of the first seating groove 21 by the rotation of the shaft 20 and may be inserted into the first through hole 41 and the second seating groove (11).

In addition, in a state where the clutch roll 45 is inserted into the second seating groove 11 and the through hole 41, when the shaft 20 reversely rotates beyond the first angle, the first seating groove 21, the through hole 41, and the second seating groove may communicate with each other.

In this case, the clutch roll 45 having the center point outside the second seating groove 11 may come out of the first seating groove 21 by the reverse rotation of the clutch member 40 caused by the elastic restoring force of the compressed torsion spring 60, and may be inserted into the first through hole 41 and the second seating groove 11.

In addition, in order to limit the rotational angle of the shaft 20, an elongate rotary groove may be formed at an outer surface of the shaft 20 in the circumferential direction.

Further, a stopper having one end inserted into the rotary groove may be installed in the housing 10.

Due to the rotary groove and the stopper, when the shaft 20 rotates, the shaft 20 may be caught by the stopper inserted into the rotary groove so that the rotational angle of the shaft 20 may be limited.

Meanwhile, the damper unit 30 may include a blocking member 31 and a blade 32.

Figure 12:
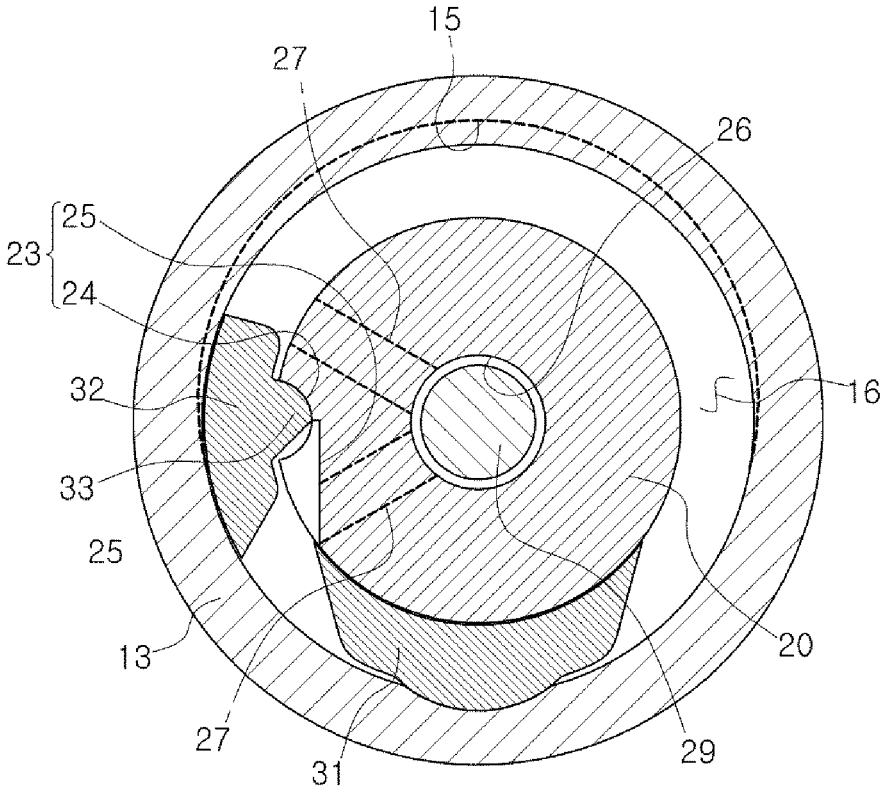
FIG. 12 is a sectional view taken along line C-C of FIG. 2.

As shown in FIG. 12, one end of the blocking member 31 may be fixedly coupled to the inner peripheral surface of the first inner chamber 16, and the other end of the blocking member 31 may come in contact with the outer circumferential surface of the shaft 20, thereby preventing the oil filled in the first inner chamber 16 from moving across the blocking member 31.

Therefore, when the shaft 20 rotates, the blocking member 31 may be fixed together with the housing 10, so that the oil filled in the first inner chamber 16 and moved by the shaft 20 may be blocked by the blocking member 31, thereby generating hydraulic pressure.

The blade 32 may be disposed between the shaft 20 and the inner peripheral surface of the first inner chamber 16 and may vary the amount of movement of the oil filled in the first inner chamber 16 when the housing 10 and the shaft 20 rotate relative to each other.

When the shaft 20 rotates, the blade 32 may move together with the shaft 20 while making contact with the inner peripheral surface of the first inner chamber 16.

A third seating groove 23 in which the blade 32 is seated may be formed in the outer peripheral surface of the shaft 20.

When the shaft 20 rotates forward, the blade 32 may be spaced apart from the third seating groove 23 so that the oil may flow therebetween.

In addition, when the shaft 20 rotates in the reverse direction, the blade 32 may come in close contact with the third seating groove 23, thereby blocking the oil flowing between the blade 32 and the third seating groove 23.

Figure 5:
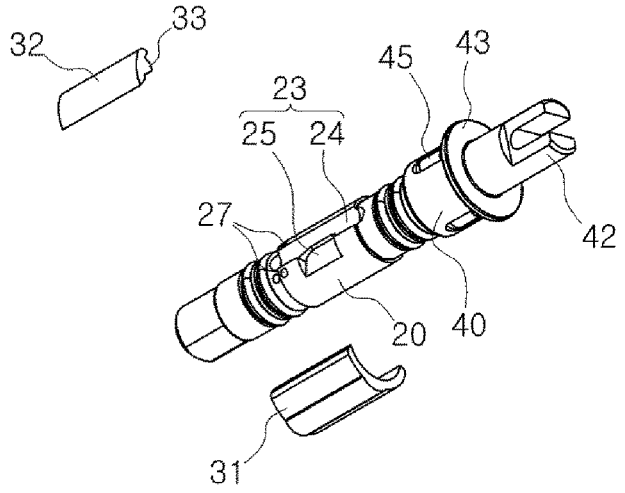
FIG. 5 is a perspective view showing a coupling state of a clutch member of a shaft of a hinge device for a rotating door according to an embodiment of the present invention.

As shown in FIGS. 5 and 12, the third seating groove 23 may include a third-first seating groove 24 and a third-second seating groove 25.

The third-first seating groove 24 may be an arc-shaped groove, and may be concaved on the outer peripheral surface of the shaft 20 in the longitudinal direction of the shaft 20.

The third-second seating groove 25 formed by chamfering the shaft 20 from the third-first seating groove 24 in the circumferential direction of the shaft 20 such that the third-second seating groove 25 has a depth greater than a depth of the third-first seating groove 24.

The size of the third-second seating groove 25 may be smaller than the size of the third-first seating groove 24.

In addition, the blade 32 may be provided with a seating protrusion 33 seated in the third-first seating groove 24.

The seating protrusion 33 may be smaller than the third-first seating groove 24 and may be movably disposed within the third-first seating groove 24.

As shown in FIG. 13, when the shaft 20 rotates forward, the seating protrusion 33 may be pushed toward the third-second seating groove 25 by the oil so that the third-first seating groove 24 may communicate with the third-second seating groove 25. Thus, the blade 32 may be spaced apart from the third seating groove 23 so that the oil may flow therebetween.

Further, as shown in FIG. 14, when the shaft 20 rotates in the reverse direction, the seating projection 33 may be pushed opposite to the third-second seating groove by the oil. Thus, the seating projection 33 may come into close contact with the third-first seating groove 24 thereby blocking the oil flowing between the blade 32 and the third seating groove 23.

Due to the blade 32 and the third seating groove 23, a difference in damping force may occur during the forward and reverse rotations of the shaft 20.

In addition, a first fluid path 15 may be formed in an inner peripheral surface of the first inner chamber 16 along the circumferential direction of the housing 10.

When the shaft 20 rotates, the blade 32 may move in contact with the inner peripheral surface of the first inner chamber 16 through a portion in which the first fluid path 15 is absent and a portion in which the first fluid path 15 is present.

When the blade 32 is disposed in the portion in which the first fluid path 15 is present, the oil may move opposite to the blade 32 through the first fluid path 15.

Therefore, when the shaft 20 rotates, if the blade 32 is disposed in the portion in which the first fluid path 15 is absent, the oil may rarely flow so that the shaft 20 may rotate somewhat slowly. When the blade 32 is disposed in the portion where the first fluid path 15 is present, the oil may flow through the first fluid path 15 so that the shaft 20 may rotate faster.

In addition, a bolt insertion hole 26 may be formed at the center of the shaft 20, and an oil adjusting bolt 29 may be installed in the bolt insertion hole 26.

The shaft 20 may be formed with a bypass passage 27 that allows the bolt insertion hole 26 to communicate with the outer circumferential surface of the shaft 20, and the communication size between the bypass passage 27 and the bolt insertion hole 26 may vary by the oil adjusting bolt 29 so that the amount of movement of the oil through the bypass passage 27 may be adjusted.

That is, the oil filled in the first inner chamber 16 may move in the opposite direction through the bypass passage 27 and the bolt insertion hole 26 when the housing 10 and the shaft 20 rotate relative to each other, thereby generating the damping force.

The present invention may further include a height adjusting nut 71, a height adjusting ring 72 and a snap ring 73.

The height adjusting nut 71 may be screwed to the outer peripheral surface of one end of the first housing 13.

One end of the height adjusting ring 72 may be exposed to the outside of one end of the height adjusting nut 71 and one end of the housing 10, and the other end thereof may be inserted between the height adjusting nut 71 and the housing 10.

The snap ring 73 may be disposed between the height adjusting nut 71 and the height adjusting ring 72 to couple the height adjusting nut 71 and the height adjusting ring 72 such that the height adjusting nut 71 and the height adjusting ring 72 can move in the longitudinal direction of the housing 10 together.

Figure 11:
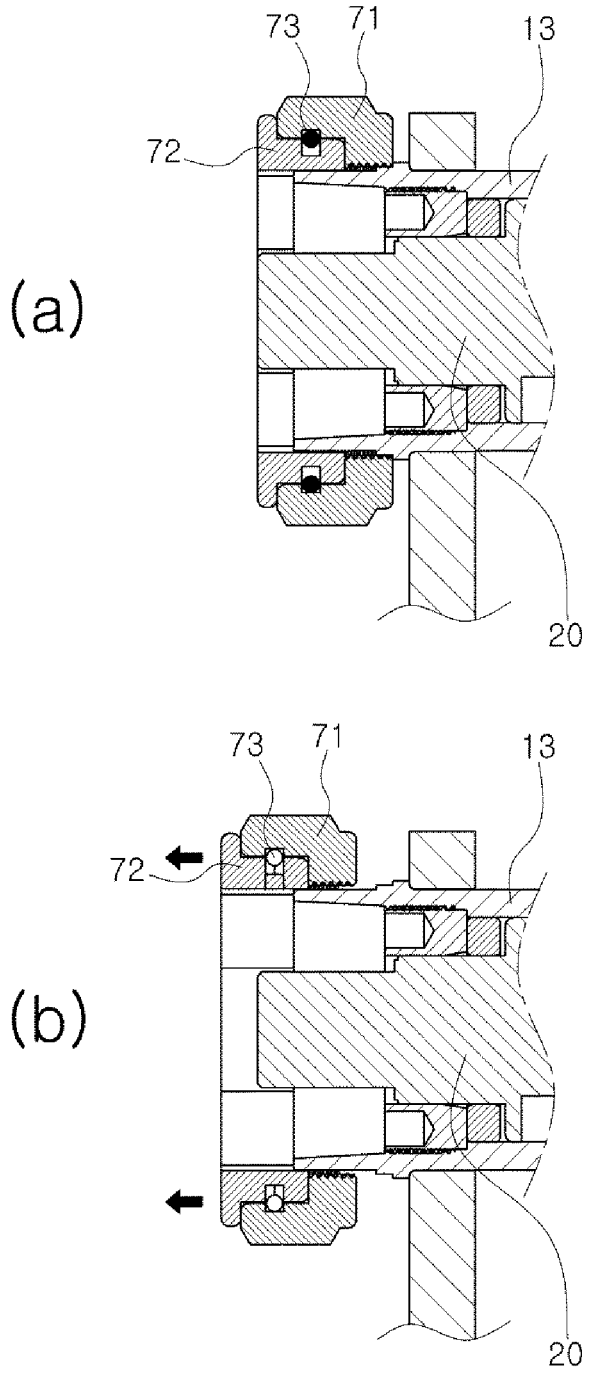
FIG. 11 is a sectional view showing an operation of a height adjusting nut and a height adjusting ring according to an embodiment of the present invention.

As shown in FIG. 11, since the height adjusting nut 71 is screwed to the housing 10 when the height adjusting nut 71 rotates with respect to the housing 10, the height adjusting nut 71 may move in the longitudinal direction of the housing 10.

In this case, the height adjusting ring 72 coupled to the height adjusting nut 71 through the snap ring 73 may move in the longitudinal direction of the housing 10 to adjust the distance with respect to one end of the housing 10.

Thus, when the housing 10 is vertically arranged and mounted in the door of the refrigerator, the height adjusting ring 72 may move in the longitudinal direction of the housing 10, so that the distance between the housing 10 and the body object, that is, the refrigerator body may be adjusted. Thus, the overall height of the hinge device may be adjusted.

Hereinafter, an operation process of the present invention having the above-described configuration will be described.

Figure 8:
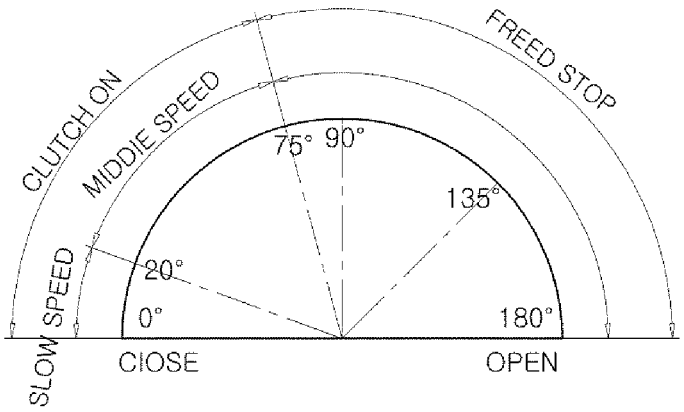
FIG. 8 is a view for explaining an operation of a hinge device for a rotating door at each angle upon rotation according to an embodiment of the present invention.

FIG. 8 is a view for explaining an operation of a hinge device for a rotating door at each angle upon rotation according to an embodiment of the present invention.

As shown in FIG. 8, according to the present embodiment, there are provided a compression section which ranges from 0 to 75 degrees and in which the shaft 20 rotates forward to compress the torsion spring 60 by the external force, a free stop section which exceeds 75 degrees and in which the shaft 20 freely rotates, and a recovery section which ranges from 75 degrees to 0 in the clockwise direction and in which the shaft 20 automatically rotates in a reverse direction by an elastic restoring force of the torsion spring 60.

In addition, when the blade 32 comes in contact with the inner peripheral surface of the housing 10 having no first fluid path 15, the shaft 20 may rotate more slowly.

The configuration of each component according to the rotation of the shaft in the present invention is as follows.

Figure 9:
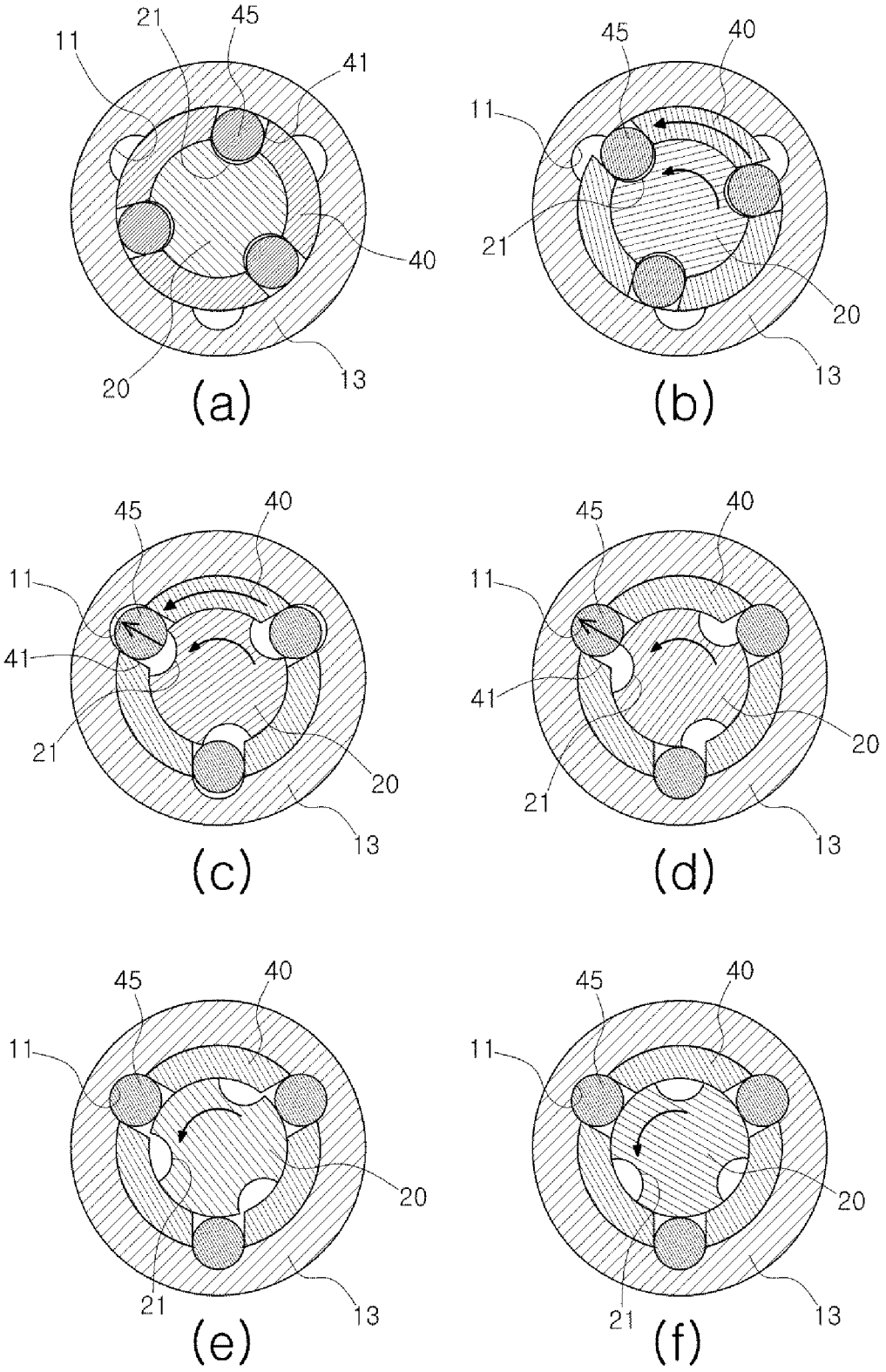
FIG. 9 is a sectional view for explaining a process of forward rotation of a shaft of a hinge device for a rotating door shown in FIG. 7 according to an embodiment of the present invention.

In the initial stop position in which the shaft 20 is not rotated, as shown in FIG. 9(*a*) , the clutch roll 45 may be inserted into the through hole 41 and the first seating groove 21.

In this case, the torsion spring 60 may generate a force to rotate the shaft 20 in the reverse direction.

Further, as shown in FIG. 13*a*, the blade 32 is disposed adjacent to the blocking member 31.

In this state, when the shaft 20 rotates forward by the external force, as shown in FIG. 9(*b*), the clutch member 40 may rotate together by the clutch roll 45 inserted into the first seating groove 21 of the shaft 230.

In this case, the torsion spring 60 coupled to the clutch member 40 may be gradually compressed as the clutch member 40 rotates.

As the shaft 20 further rotates, the shaft 20 may reach a section in which the first seating groove 21, the through hole 41, and the second seating groove 11 communicate with each other, that is, the first angle which is 75 degrees in the present embodiment.

That is, when the shaft 20 rotates forward, the shaft 20 and the clutch member 40 may rotate together by the clutch roll 45 until they reach the first angle while compressing the torsion spring 60.

In this state, when the shaft 20 further rotates forward, as shown in FIG. 9(*c*), the clutch roll 45 may be pushed by the rotation of the shaft 20 so that the clutch roll 45 may come out of the first seating groove 21 and a part of the clutch roll 45 may move to the second mounting groove 11 across the through hole 41.

As the part of the clutch roll 45 is inserted into the through hole 41 and the second seating groove 11, the clutch member 40 may be caught by the housing 10 through the clutch roll 45 so that the clutch member 40 does not rotate anymore.

Therefore, as shown in FIGS. 9(*c*) and (*d*), the clutch roll 45 may completely come out of the first seating groove 21 and may be inserted into the through hole 41 and the second seating groove 11 as the shaft 20 rotates beyond the first angle. Thus, the free stop section may be generated, in which the rotational force of the shaft 20 may not be transferred to the clutch member 40 even when the shaft 20 rotates.

After that, as shown in FIGS. 9(*e*) and (*f*), even if the shaft 20 rotates to 180 degrees, the rotational force of the shaft 20 may not be transferred to the clutch member 40 and the clutch roll 45. Thus, only the shaft 20 may rotate without the rotation of the clutch member 40 and the clutch roll 45, and the rotation of the shaft 20 may not affect the torsion spring 60.

In this case, the reverse rotational power may act on the clutch member 40 by the torsion spring 60. Since the clutch member 40 is caught by the housing 10 through the clutch roll 45, the clutch member 40 may remain at the first angle even if the reverse rotational force is applied thereto by the torsion spring 60.

In addition, since the center point of the clutch roll 45 is located outside the second seating groove 11, the clutch roll 45 may not move while being caught by the outer circumferential surface of the shaft 20 and may be inserted into the through hole 41 and the second seating groove 11, even if a force to move the clutch roll 45 inward from the second seating groove 11 acts on the clutch roll 45 by the reverse rotational force of the clutch member 40 caused by the torsion spring 60.

As described above, the shaft 20 may freely rotate in the forward and reverse directions through the free stop scheme from the first angle where the second seating groove 11 is formed.

Figure 10:
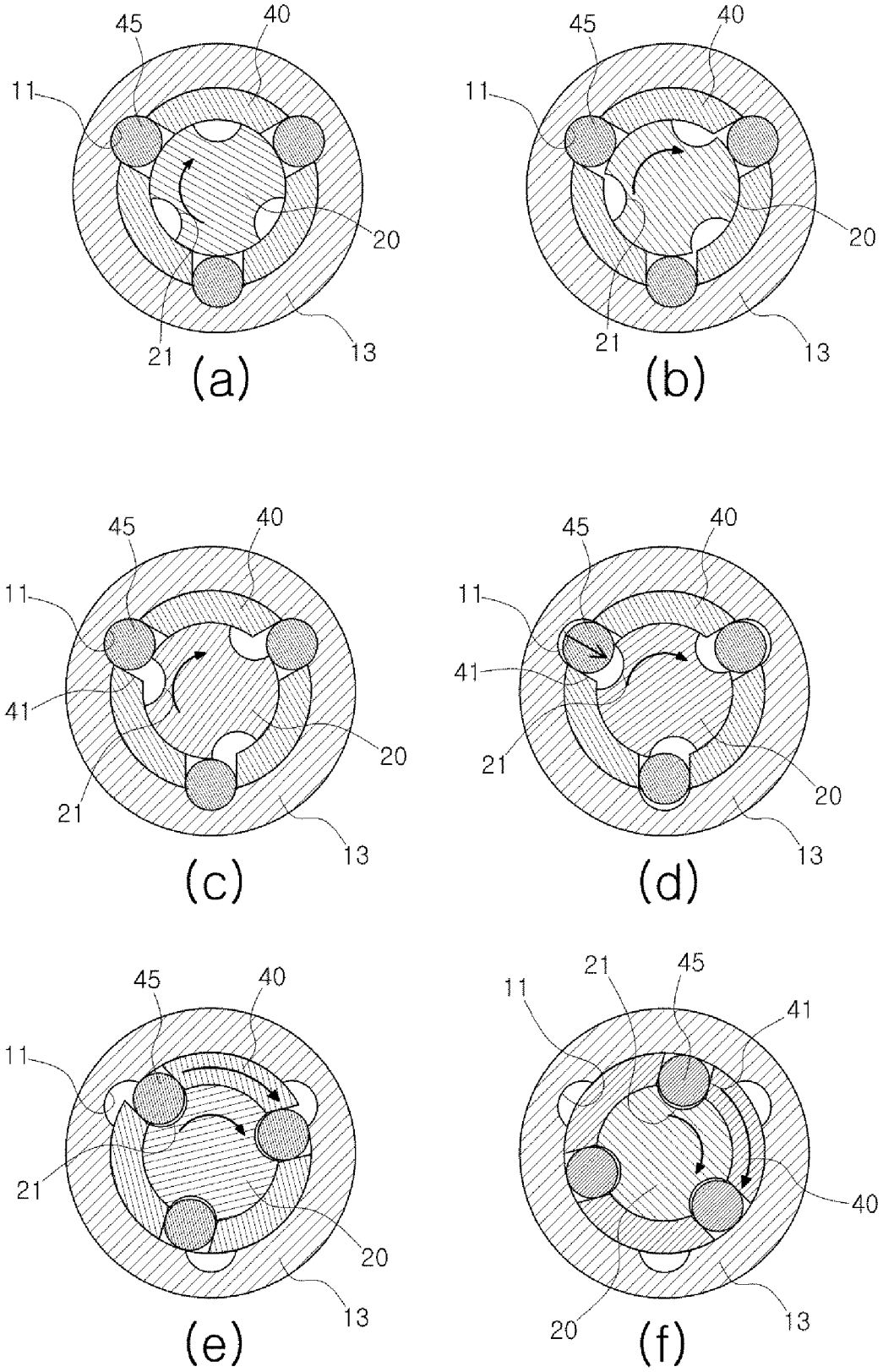
FIG. 10 is a sectional view for explaining a process of reverse rotation of a shaft of a hinge device for a rotating door shown in FIG. 9 according to an embodiment of the present invention.

Meanwhile, in a state where the shaft 20 rotates forward beyond the first angle, when the shaft 20 rotates in the reverse direction by the external force, as shown in FIGS. 10(*a*) to (*c*), only the shaft 20 may freely rotate without the elastic restoring force of the torsion spring 60.

In this process, as shown in FIGS. 13 and 14, the oil filled in the first inner chamber 16 may be pushed by the rotation of the shaft 20 and the blade 32 and flow through the first fluid path 15 and the third seating groove 23, thereby generating some damping force.

As shown in FIG. 13, when the shaft 20 rotates forward, the oil that flows while being pushed by the blade 32 may move through the third seating groove 23. In addition, when the blade 32 reaches the portion in which the first fluid path 15 is present, the oil may further move through the first fluid path 15, so that the shaft 20 may more easily rotate.

Then, as shown in FIG. 10(*d*), when the shaft 20 further rotates in the reverse direction so that the first seating groove 21 communicates with the through hole 41, the clutch roll 45 may move inward from the second seating groove 11 due to the reverse rotational force of the clutch member 40 caused by the torsion spring 60. When the shaft 20 reaches the first angle, the clutch roll 45 may gradually come out of the second seating groove 11 and may be gradually inserted into the through hole 41 and the first seating groove 21.

From this point, the clutch roll 45 may come out of the second seating groove 11 and the clutch member 40 may rotate in the reverse direction by the reverse rotational force caused by the elastic restoring force of the torsion spring 60 acting on the clutch member 40.

As the rotational force acts on the clutch member 40 in the reverse direction by the torsion spring 60, as shown in FIG. 10(*e*), the recovery section may be generated in which the clutch member 40 automatically rotates in the reverse direction together with the shaft 20 through the clutch roll 45.

Therefore, as shown in FIG. 10(*f*), the shaft 20 may return to the initial stop position by the elastic restoring force of the torsion spring 60.

Accordingly, as shown in FIGS. 10(*f*), the shaft 20 may return to the initial stop position by the elastic restoring force of the torsion spring 60.

Further, as the shaft 20 rotates in the reverse direction, as shown in FIG. 14, the oil filled in the first inner chamber 16 may be pushed by the rotation of the shaft 20 and the blade 32.

In this case, the blade 32 may come in close contact with the third-first seating groove 24 when the shaft 20 rotates in the reverse direction to block the communication between the third-first seating groove 24 and the third-second seating groove 25. Thus, the oil may be prevented from moving between the blade 32 and the third seating groove 23.

In addition, when the blade 32 comes in contact with the inner peripheral surface of the housing 10 at the portion where the first fluid path 15 is present, the oil may flow through the first fluid path 15, so that the shaft 20 may rotate in the reverse direction somewhat fast. Then, when the blade 32 reaches the portion in which the first fluid path 15 is absent, the shaft 20 may rotate slowly in the reverse direction.

As described above, the present invention may be applied to the door of the refrigerator door or the like in use.

In a state where the housing 10 is installed in the body object 82 (the refrigerator body) and the shaft 20 is connected to the rotating door, when the refrigerator door 81 is opened, the user forcibly rotates the shaft by applying the external force until the shaft 20 reaches the predetermined first angle. In addition, in the remaining angular positions beyond the first angle, the shaft may rotate through the free stop scheme, in which the shaft may not automatically rotate. When the refrigerator door 81 is closed, if the rotated shaft 20 reaches the predetermined first angle, the shaft and the refrigerator door 81 may be automatically rotated and closed by the elastic restoring force of the torsion spring 60.

As described above, according to the present invention, since the shaft 20 and the refrigerator door rotate through the free stop scheme in a section beyond the first angle, the refrigerator door may remain in an opened state even when the user does not hold the refrigerator door in the state beyond the first angle. Thus, the user may hold a heavy and large object by using two hands in a state where the refrigerator door is opened, or many objects may be easily put into or removed from the inside of the refrigerator. In addition, when it reaches the first angle through the reverse rotation, the refrigerator door can be automatically closed so that the convenience can be improved.

On the contrary, the shaft 20 may be connected to the body object 82, and the housing 10 may be mounted to the door 81. In this case, the housing 10 may rotate.

The hinge device for the rotating door of the present invention can be applied to a washing machine, a styler, a glass door, a room door, and the like, in which a door is rotatably installed, as well as the refrigerator.

The hinge device for the rotating door of the present invention is not limited to the above-described embodiment, and may be variously modified and implemented within the range in which the technical idea of the present invention is permitted.

What is claimed is:

1. A hinge device for a rotating door, the hinge device comprising:

a hollow housing having one end and an opposite end, the housing provided therein with a first inner chamber and a second inner chamber communicated with each other, in which the first inner chamber is filled with oil;

a shaft rotatably mounted to the housing while passing through the first inner chamber, in which one end of the shaft is exposed to an outside through the one end of the housing, an opposite end of the shaft is inserted into the first inner chamber, an outer circumferential surface of the shaft is spaced apart from the first inner chamber such that oil is filled therebetween, and a first seating groove is formed at an outer circumferential surface of the opposite end of the shaft;

a damper unit installed in the first inner chamber to adjust an amount of flow of the oil filled in the first inner chamber during relative rotation of the housing and the shaft;

a clutch roll inserted into the first seating groove in the second inner chamber;

a clutch member having one end surrounding the opposite end of the shaft in the second inner chamber, in which a first coupling protrusion protrudes from an opposite end of the clutch member, a through hole is formed at the one end of the clutch member surrounding the shaft, and the clutch roll is inserted into the through hole;

a support member mounted to the opposite end of the housing and having a second coupling protrusion protruding toward an inside of the housing; and a torsion spring installed inside the housing and having one end coupled to the first coupling protrusion and an opposite end coupled to the second coupling protrusion, wherein a second seating groove is formed at an inner peripheral surface of the housing such that the clutch roll inserted into the through hole is seated in the second seating groove, a rotational force of the shaft is transferred to the clutch member through the clutch roll when the shaft rotates in a state where the clutch roll is inserted into both the first seating groove and the through hole, thereby rotating the clutch member together with the shaft, and only the shaft independently rotates without rotation of the clutch roll and the clutch member when the shaft rotates in a state where the clutch roll is inserted into both the through hole and the second seating groove.

2. The hinge device of claim 1, wherein the hinge device of the rotating door includes:

a compression section, in which the clutch member rotates together with the shaft from an initial stop position to a predetermined first angle to compress the torsion spring when the shaft rotates forward by an external force;

a free stop section in which the shaft rotates freely without compression or decompression of the torsion spring when the shaft rotates forward or backward in a state of exceeding the predetermined first angle; and a recovery section in which the shaft automatically rotates in a reverse direction by an elastic restoring force of the torsion spring to return to the initial stop position when the shaft rotates reversely below the predetermined first angle in the free stop section.

3. The hinge device of claim 2, wherein the second seating groove is formed at a position corresponding to the predetermined first angle, the clutch roll is inserted into the first seating groove and the through hole in the compression section and the recovery section so that the shaft, the clutch roll, and the clutch member rotate together, and the clutch roll is inserted into the through hole and the second seating groove in the free stop section so that the shaft rotates independently from the clutch roll and the clutch member.

4. The hinge device of claim 3, wherein each of a depth of the first seating groove, a depth of the second seating groove, and a depth of the through hole is smaller than a diameter of the clutch roll, so that a center point of the clutch roll is disposed outside the first seating groove in a state where the clutch roll is inserted into the first seating groove and the through hole, and the center point of the clutch roll is disposed outside the second seating groove in a state where the clutch roll is inserted into the second seating groove and the through hole.

5. The hinge device of claim 4, wherein, in a state where the clutch roll is inserted into the first seating groove and the through hole, when the shaft rotates forward beyond the predetermined first angle, the first seating groove, the through hole, and the second seating groove communicate with each other, and the clutch roll comes out of the first seating groove and is inserted into the through hole and the second seating groove by the rotation of the shaft, and in a state where the clutch roll is inserted into the second seating groove and the through hole, when the shaft reversely rotates beyond the predetermined first angle, the first seating groove, the through hole, and the second seating groove communicate with each other, and the clutch roll comes out of the first seating groove and is inserted into the through hole and the second seating groove by the rotation of the clutch member caused by the elastic restoring force of the torsion spring.

6. The hinge device of claim 3, wherein a reverse rotational force caused by the elastic restoring force of the torsion spring is applied to the shaft in the initial stop position.

7. The hinge device of claim 6, wherein the first seating grooves are formed at intervals of 120 degrees, the clutch roll includes three clutch rolls, the second seating grooves are formed at intervals of 120 degrees, and the predetermined first angle is less than 90 degrees at the initial stop position.

8. The hinge device of claim 1, wherein the housing includes:

a first housing in which the shaft is disposed, the first housing having one end and an opposite end; and a second housing having one end coupled to the opposite end of the first housing and the second housing having an opposite end on which the support member is mounted, and provided therein with the torsion spring, and a latching protrusion protrudes between the one end and the opposite end of the clutch member in a circumferential direction, and the latching protrusion is mounted between the first and second housings such that the latching protrusion is rotatable and linear movement of the latching protrusion is prevented.

9. The hinge device of claim 8, further comprising a bearing surrounding the opposite end of the clutch member, wherein one end of the bearing is latched to an inner peripheral surface of the one end of the second housing, and the latching protrusion is disposed between the bearing and the opposite end of the first housing so that the latching protrusion is rotatable and the linear movement of the bearing is prevented.

10. The hinge device of claim 1, further comprising:

a height adjusting nut screwed to the one end of the housing;

a height adjusting ring having one end exposed to an outside of one end of the height adjusting nut and the one end of the housing, and an opposite end inserted between the height adjusting nut and the housing; and a snap ring configured to couple the height adjusting nut and the height adjusting ring to move the height adjusting nut and the height adjusting ring together in a longitudinal direction of the housing, wherein, when the height adjusting nut rotates relative to the housing, the height adjusting ring coupled to the height adjusting nut through the snap ring moves in the longitudinal direction of the housing to adjust a distance with respect to the one end of the housing.

11. The hinge device of claim 1, wherein the damper unit includes:

a blocking member having one end fixedly coupled to an inner peripheral surface of the first inner chamber and an opposite end making contact with an outer circumferential surface of the shaft; and a blade disposed between the shaft and the inner peripheral surface of the first inner chamber, wherein, when the shaft rotates, the blocking member is fixed together with the housing and the blade moves together with the shaft while making contact with the inner peripheral surface of the first inner chamber, and the blade changes an amount of movement of the oil filled in the first inner chamber.

12. The hinge device of claim 11, wherein a first fluid path is concavely formed at the inner peripheral surface of the first inner chamber in a circumferential direction of the housing, the blade is disposed in a longitudinal direction of the shaft, when the shaft rotates, the blade moves through a portion where the first fluid path is absent and a portion where the first fluid path is present in contact with the inner peripheral surface of the first inner chamber, the oil moves through the first fluid path when the blade is disposed in the portion where the first fluid path is present, and the shaft rotates more slowly when the blade is disposed in the portion where the first fluid path is absent than when the blade is disposed in the portion where the first fluid path is present.

13. The hinge device of claim 12, wherein a third seating groove where the blade is seated is formed on the outer circumferential surface of the shaft, the blade is spaced apart from the third seating groove and the oil moves therebetween when the shaft rotates forward, and the blade comes in close contact with the third seating groove to block movement of the oil between the blade and the third seating groove when the shaft reversely rotates.

14. The hinge device of claim 13, wherein the third seating groove includes:

a third-first seating groove having an arc shape; and a third-second seating groove formed by chamfering the shaft from the third-first seating groove in the circumferential direction of the shaft such that the third-second seating groove has a depth greater than a depth of the third-first seating groove, and the blade is provided with a seating protrusion seated in the third-first seating groove, the seating protrusion is smaller than the third-first seating groove and movably disposed in the third-first seating groove, when the shaft rotates forward, the seating protrusion is pushed toward the third-second seating groove by the oil and allows the third-first seating groove to communicate with the third-second seating groove so that the blade is spaced apart from the third seating groove and the oil moves therebetween, and when the shaft reversely rotates, the seating protrusion is pushed opposite to the third-second seating groove by the oil and comes in close contact with the third-first seating groove to prevent the oil from moving between the blade and the third seating groove.

15. The hinge device of claim 14, wherein the shaft is formed at a center thereof with a bolt insertion hole, an oil adjusting bolt is installed in a bolt insertion hole, a bypass passage is formed in the shaft to allow the bolt insertion hole to communicate with the outer circumferential surface of the shaft, and a size of communication between the bypass passage and the bolt insertion hole is variable by the oil adjusting bolt so that an amount of movement of the oil through the bypass passage is controlled.

* * * * *